US008261665B1

(12) United States Patent
Walsh

(10) Patent No.: US 8,261,665 B1
(45) Date of Patent: Sep. 11, 2012

(54) FLUID-MARKER DELIVERY SYSTEMS

(76) Inventor: Thomas Patrick Walsh, Glendale, AZ (US)

( * ) Notice: Subject to any disclaimer, the term of this patent is extended or adjusted under 35 U.S.C. 154(b) by 298 days.

(21) Appl. No.: 12/534,075

(22) Filed: Jul. 31, 2009

Related U.S. Application Data

(60) Provisional application No. 61/085,629, filed on Aug. 1, 2008, provisional application No. 61/175,821, filed on May 6, 2009.

(51) Int. Cl.
*F42B 8/12* (2006.01)

(52) U.S. Cl. ..... 102/498; 102/502; 102/513; 102/529

(58) Field of Classification Search ..... 102/502, 102/513, 529, 498, 444, 445, 482
See application file for complete search history.

(56) References Cited

U.S. PATENT DOCUMENTS

| | | | | |
|---|---|---|---|---|
| 3,785,569 | A * | 1/1974 | Helmrich | 239/337 |
| 3,878,639 | A * | 4/1975 | Scheelar et al. | 446/473 |
| 4,627,354 | A * | 12/1986 | Diamond et al. | 102/368 |
| 4,932,672 | A | 6/1990 | Tippmann | |
| 5,018,449 | A | 5/1991 | Eidson | |
| 5,354,225 | A | 10/1994 | Hix | |
| 5,590,886 | A | 1/1997 | Lush | |
| 5,996,503 | A | 12/1999 | Woodall et al. | |
| 6,209,461 | B1 * | 4/2001 | Riffet et al. | 102/513 |
| 6,453,819 | B1 | 9/2002 | Coates | |
| 6,581,521 | B1 | 6/2003 | Dixon et al. | |
| 6,598,807 | B1 | 7/2003 | Anzalone | |
| 6,688,234 | B2 | 2/2004 | Huber et al. | |
| 6,871,594 | B1 | 3/2005 | Estrella | |
| 7,261,041 | B2 | 8/2007 | Brock | |
| 7,338,343 | B2 | 3/2008 | Siu et al. | |
| 7,565,866 | B1 * | 7/2009 | Downes | 102/482 |
| 2006/0156943 | A1 | 7/2006 | Tippmann | |

* cited by examiner

*Primary Examiner* — James Bergin
(74) *Attorney, Agent, or Firm* — Stoneman Law Patent Group; Martin L. Stoneman; Kyle Liudahl

(57) ABSTRACT

A system relating to non-lethal gas-pressurized hand grenades used in the game of paintball, or other recreational war games. The system provides for an air-pressurized paintball grenade that is thrown or otherwise ballistic delivered to the target. The paintball grenade does not trigger until delivered to the target. It is constructed to be easily refilled and pressurized for repeated, safe, and environmentally friendly use. The paintball grenade comprises stabilizing fins, an integral hand-pump for pressurization, a trigger blocker, and attaching apparatus for carrying.

21 Claims, 8 Drawing Sheets

FLUID-MARKER DELIVERY SYSTEMS

CROSS-REFERENCE TO RELATED APPLICATION

The present application is related to and claims priority from prior provisional application Ser. No. 61/085,629, filed Aug. 1, 2008, entitled "AIR PRESSURIZED PAINTBALL GRENADE"; and this application is related to and claims priority from prior provisional application Ser. No. 61/175,821, filed May 6, 2009, entitled "PAINT DELIVERY SYSTEMS", the contents of all of which are incorporated herein by this reference and are not admitted to be prior art with respect to the present invention by the mention in this cross-reference section.

BACKGROUND

This invention relates to fluid-marking delivery systems. More particularly, this invention relates to providing such systems relating to providing non-lethal gas-pressurized hand grenades for use in the game of paintball, or other recreational war games.

In paintball-based recreational war games, competitors attempt to shoot other competitors with fluid-markers called paintballs (which may or may not include traditional "paint" but do include a marking fluid of some type) projected from paintball guns (also known as paintball markers). In such combat-type events, players attempt to accurately simulate actual militaristic scenarios wherein being "hit" or marked by a fluid-marker results in game-play as being shot or killed-in-action and the player typically is out of the game. Heretofore, devices for effectively simulating the use of hand-thrown grenades in paintball-base play have been unavailable. Thus, a need exists for such devices capable of enhancing this specialized area of the sport of paintball.

OBJECTS AND FEATURES OF THE INVENTION

A primary object and feature of the present invention is to provide a system overcoming the above-mentioned problems.

It is a further object and feature of the present invention to provide such a system that is re-usable, being easily refillable for repeated, safe, and environmentally-friendly use.

It is another object and feature of the present invention to provide such a system that comprises reasonably high accuracy when thrown.

It is another object and feature of the present invention to provide such a system that comprises a paintball grenade with an integral air pump.

It is another object and feature of the present invention to provide such a system that comprises a non-lethal fluid-marking grenade with a 360-degree dispersal of marking fluid when triggered.

It is another object and feature of the present invention to provide such a system that comprises a paintball grenade with a removable trigger blocker.

It is another object and feature of the present invention to provide such a system that comprises a fluid-marker that assists accurate ballistic delivery of marking fluid.

It is another object and feature of the present invention to provide such a system that comprises a paintball grenade carrier for carrying a paintball grenade in a trigger safety position.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a system relating to spraying fluid from at least one paintball grenade, such system comprising: at least one marker-container structured and arranged to contain at least one pressurized marker fluid; at least one release-controller structured and arranged to control release of such at least one pressurized marker fluid; at least one patterned-disperser structured and arranged to disperse such released pressurized marker fluid in at least one pre-determined pattern; and at least one trigger structured and arranged to trigger such at least one release controller upon impact of the at least one paintball grenade; wherein such at least one trigger comprises such at least one patterned-disperser. Moreover, it provides such a system further comprising at least one flight-stabilizer structured and arranged to aerodynamically stabilize the at least one paintball grenade.

Additionally, it provides such a system wherein such at least one flight stabilizer comprises at least one fluid pressurizer structured and arranged to pressurize marker fluid. Also, it provides such a system wherein such at least one fluid pressurizer comprises at least one hand-pumper structured and arranged to hand-pump to pressure such marker fluid. In addition, it provides such a system wherein such at least one pattern-disperser comprises at least one reflector structured and arranged to reflect such released pressurized marker fluid in the at least one pre-determined pattern. And, it provides such a system wherein such at least one reflector disperses such released pressurized marker fluid in a 360-degree pattern. Further, it provides such a system wherein such at least one patterned-disperser disperses such released pressurized marker fluid in an arcuate pattern of not less than about 180-degrees and not more than about 360-degrees.

Even further, it provides such a system wherein such at least one flight-stabilizer comprises at least one flight-orientation biaser structured and arranged to assist biasing the in-flight orientation of such at least one trigger toward at least one ballistic-flight position promoting first impact with such at least one trigger upon impact of the at least one paintball grenade. Moreover, it provides such a system wherein such at least one flight-stabilizer comprises at least three fins.

In accordance with another preferred embodiment hereof, this invention provides a system relating to spraying fluid from at least one paintball grenade, such system comprising: at least one marker-container structured and arranged to contain pressurized marker fluid; at least one release-controller structured and arranged to control release of such pressurized marker fluid; at least one trigger structured and arranged to trigger such at least one release controller upon impact of the at least one paintball grenade; and at least one flight-stabilizer structured and arranged to aerodynamically stabilize the at least one paintball grenade. Additionally, it provides such a system wherein such at least one flight stabilizer comprises at least one fluid pressurizer structured and arranged to pressurize marker fluid.

Also, it provides such a system wherein such at least one fluid pressurizer comprises at least one hand-pumper structured and arranged to hand-pump to pressure such marker fluid. In addition, it provides such a system further comprising: at least one patterned-disperser structured and arranged to disperse such released pressurized marker fluid in at least one pre-determined pattern. And, it provides such a system wherein such at least one trigger comprises such at least one patterned-disperser.

In accordance with another preferred embodiment hereof, this invention provides a system relating to spraying fluid from at least one paintball grenade, such system comprising: at least one marker-container structured and arranged to contain pressurized marker fluid; at least one release-controller structured and arranged to control release of such pressurized marker fluid; and at least one trigger structured and arranged to trigger such at least one release controller upon impact of the at least one paintball grenade; wherein such at least one trigger comprises at least one compression-spring structured and arranged to assist preventing triggering of such at least one trigger until impact using at least one compression spring; and at least one trigger-blocker structured and arranged to block triggering of such at least one trigger; wherein such at least one trigger-blocker comprises at least one spring blocker structured and arranged to prevent compression of such at least one compression spring; and at least one attacher structured and arranged to removably attach such at least one trigger blocker to ammunition-bearing clothing. Further, it provides such a system further comprising: at least one patterned-disperser structured and arranged to disperse such released pressurized marker fluid in at least one pre-determined pattern; wherein such at least one trigger comprises such at least one patterned-disperser.

Even further, it provides such a system wherein such at least one trigger-blocker comprises a single C-shaped block structured and arranged to be situate between such at least one patterned-disperser and such at least one release-controller. Moreover, it provides such a system wherein such single C-shaped block comprises at least one handle structured and arranged to be hand graspable by a human hand. Additionally, it provides such a system wherein such at least one attacher comprises such at least one trigger-blocker. Also, it provides such a system wherein such at least one trigger-blocker comprises a single C-shaped block structured and arranged to be situate between such at least one patterned-disperser and such at least one release-controller.

In accordance with another preferred embodiment hereof, this invention provides a system relating to spraying fluid from at least one paintball grenade, such system comprising: marker-container means for containing pressurized marker fluid; release-control means for controlling release of the pressurized marker fluid; patterned-disperser means for dispersing the released pressurized marker fluid in at least one pre-determined pattern; and trigger means for triggering such release control means upon impact of the at least one paintball grenade; wherein such trigger means comprises such patterned-disperser means. In addition, it provides such a system further comprising: flight-stabilizer means for aerodynamically stabilizing the at least one paintball grenade.

In accordance with another preferred embodiment hereof, this invention provides a system relating to spraying fluid from at least one paintball grenade, such system comprising: marker-container means for containing pressurized marker fluid; release-control means for controlling release of the pressurized marker fluid; trigger means for triggering such release control means upon impact of the at least one paintball grenade; and flight-stabilizer means for aerodynamically stabilizing the at least one paintball grenade. And, it provides such a system wherein such flight stabilizer means comprises fluid pressurizer means for pressurizing marker fluid. It also provides such a system wherein such fluid pressurizer means comprises hand-pump means for hand-pumping to pressure the marker fluid.

In accordance with another preferred embodiment hereof, this invention provides a system relating to spraying fluid from at least one paintball grenade, such system comprising: marker-container means for containing pressurized marker fluid; release-control means for controlling release of the pressurized marker fluid; and trigger means for triggering such release control means upon impact of the at least one paintball grenade; wherein such trigger means comprises compression-spring means for assisting preventing triggering of such trigger means until impact using at least one compression spring; trigger-blocker means for blocking triggering of such trigger means; wherein such trigger-blocker means comprises spring blocking means for preventing compression of at least one compression spring; attacher means for removably attaching such trigger blocker means to ammunition-bearing clothing. And, it provides such a system wherein said at least one trigger-blocker comprises at least a set of projecting rods structured and arranged to trigger-block and to support the at least one paintball grenade.

DETAILED DESCRIPTION OF THE BEST MODES AND PREFERRED EMBODIMENTS OF THE INVENTION

Figure 1:
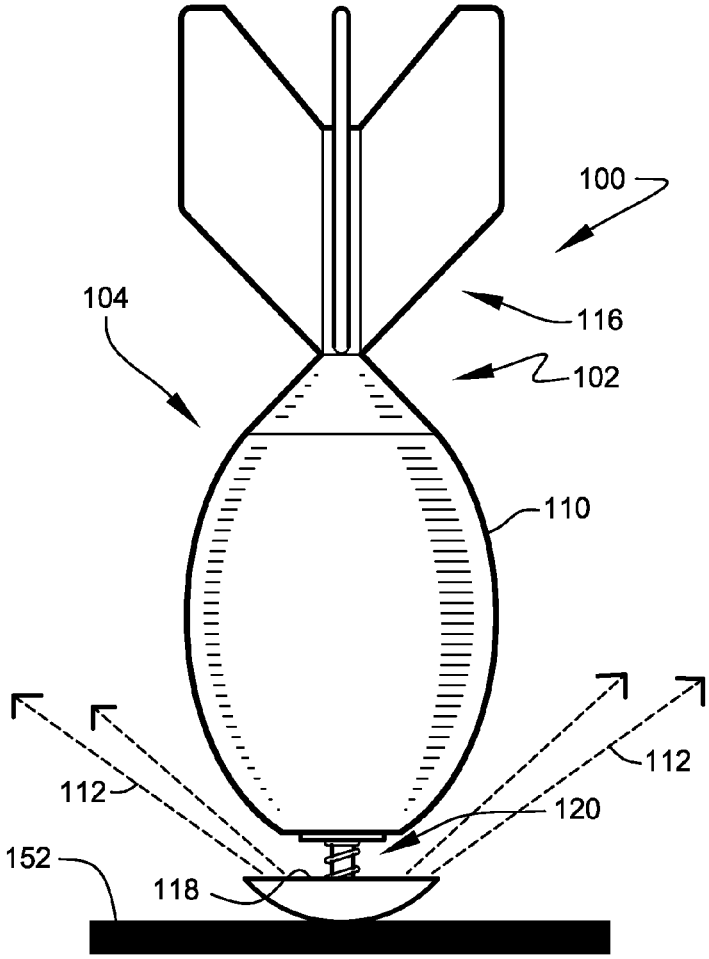
FIG. 1 shows an elevation view, illustrating a paintball grenade of the fluid-marker delivery systems, according to a preferred embodiment of the present invention.

FIG. 1 shows a perspective view illustrating, a paintball grenade 104 of the fluid-marker delivery system 100, according to a preferred embodiment of the present invention. Preferably, fluid-marker delivery system 100 comprises at least one fluid-marker 102, preferably illustrated herein as paintball grenade 104, preferably used to mark a paintball player during the game of paintball or other combat-simulation events. As used herein the term "paint" will refer to any of the fluid-marking agents that may be utilized as a marker, including, but not limited to, colored water, water-based paint, food coloring, vegetable oil, etc. Upon reading this specification, those with ordinary skill in the art will now appreciate that, under appropriate circumstances, considering such issues as user preferences, marketing preferences, cost, game requirements, available materials, technological advances, etc., other marker materials such as, for example, powder, petroleum-based materials, etc., may suffice.

Paintball grenade 104 preferably is hand-thrown by a user to deliver paintball grenade 104; therefore, paintball grenade 104 is preferably dimensioned to be hand-throwable. Of course, upon reading this specification, those with ordinary skill in the art will now appreciate that, under appropriate circumstances, considering such issues as design preference, user preferences, marketing preferences, cost, structural requirements, available materials, technological advances, etc., other ballistic delivery arrangements such as, for example, pressurized tube delivery, slingshot delivery, catapult delivery, gas-pressurized bazooka delivery, etc., may suffice.

Figure 2:
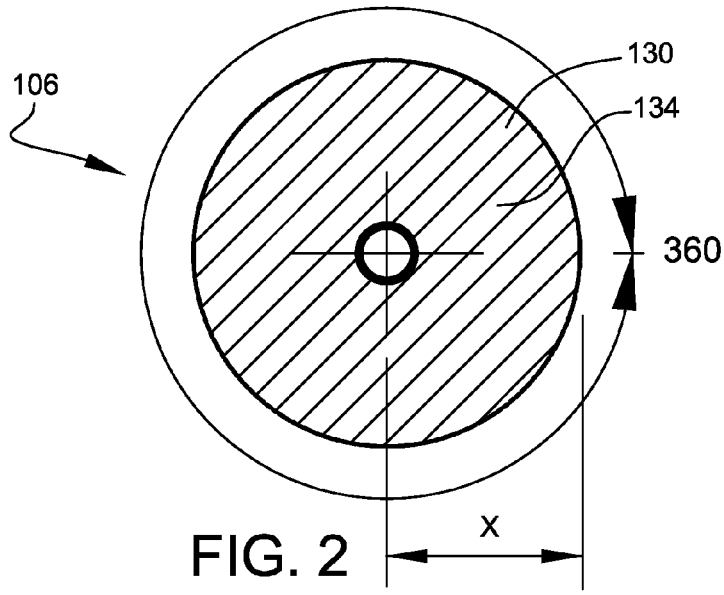
FIG. 2 shows a diagrammatic cross-sectional view, illustrating a preferred paint dispersal pattern, according to the preferred embodiment of FIG. 1.
Figure 3:
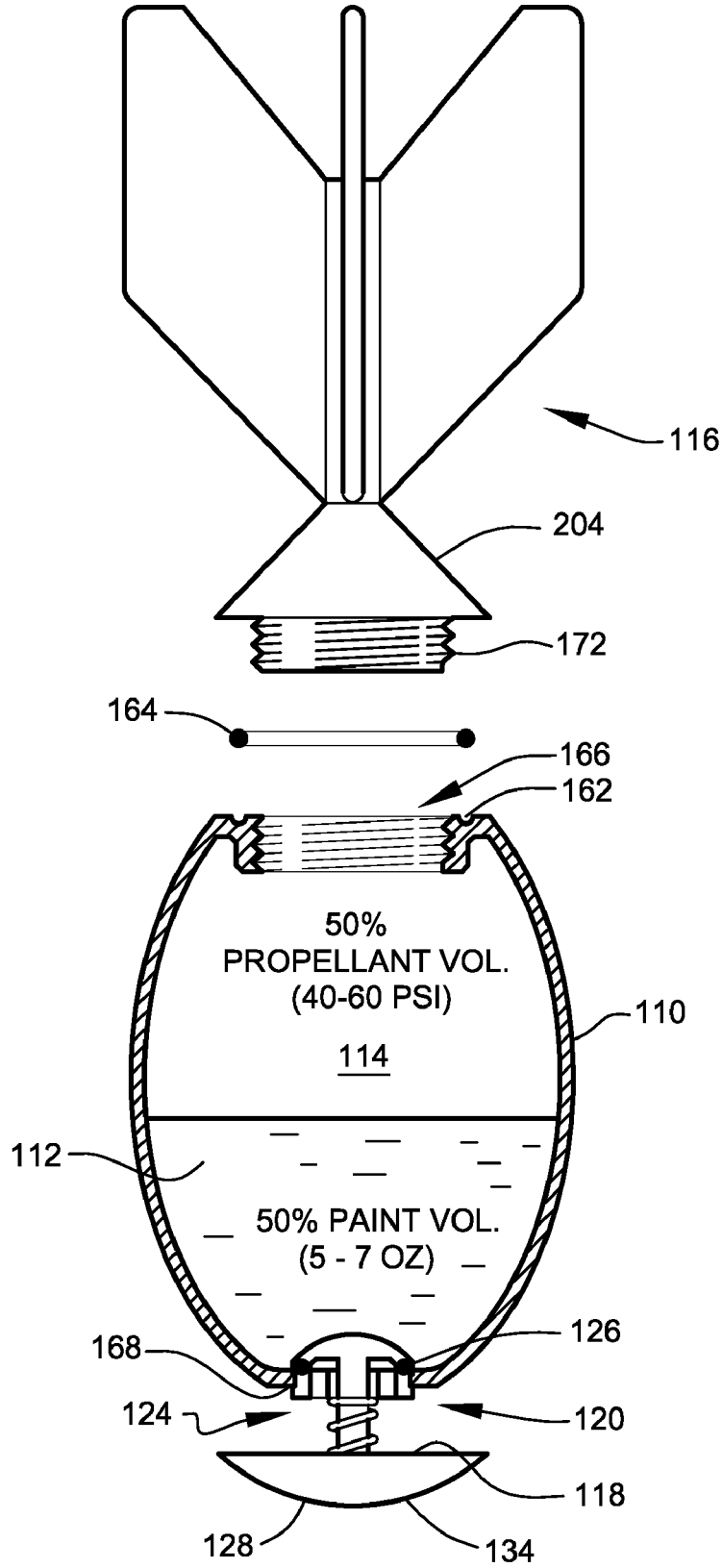
FIG. 3 shows an exploded elevation view, partially in section, illustrating the paintball grenade according to the preferred embodiment of FIG. 1.

FIG. 2 shows a diagrammatic cross-sectional view illustrating a preferred paint dispersal pattern 106, according to the preferred embodiment of FIG. 1. FIG. 3 shows an exploded perspective view, partially in section, illustrating the paintball grenade 104 according to the preferred embodiment of FIG. 1.

Paintball grenade 104 preferably comprises at least one fluid-holder portion 110 to hold paint 112, as shown. Preferably, fluid-holder portion 110 is pressurizable to allow pressurization of the paint 112, preferably by gas pressurization, which will preferably assist in dispersing the paint 112 to the target (other paintball players, for example) when triggered. Preferably, such dispersal extends in an area about 25 feet to about 30 feet in diameter from the impact point of the paintball grenade 104. Fluid-holder portion 110 (at least embodying herein marker-container means for containing pressurized marker fluid) preferably holds about five to about seven ounces of paint 112 (fluid ounces), preferably utilizing about 50% of the volume within fluid-holder portion 110, with the remaining about 50% being available for propellant 114, preferably a compressed gas, preferably compressed air, alternately preferably compressed carbon dioxide, alternately preferably compressed nitrogen, as shown. Upon reading this specification, those with ordinary skill in the art will now appreciate that, under appropriate circumstances, considering such issues as design preference, user preferences, propellant preferences, cost, fluid-holder structural requirements, available materials, technological advances, etc., other propellant arrangements such as, for example, inert gasses, chemical propellant, more or less than 50% volume, etc., may suffice.

Fluid-holder portion 110 preferably further comprises tail section 116, and trigger portion 120, as shown. Preferably, trigger portion 120 comprises disperser 118, at least one trigger activating mechanism 124 and at least one control valve 126, as shown.

Paintball grenade 104 preferably is comprised of a lightweight material capable of holding pressurized fluid and being delivered through the air (ballistic delivery). Preferably, the total paintball grenade weight is about 8 ounces to about 12 ounces (½ pound to about ¾ pound) when fluid filled. Fluid-holder portion 110 preferably is made from polyvinyl chloride (PVC) plastic or polypropylene (PP). Tail section 116 preferably is made from similar material (PVC, PP) with exception of tail fins 200 which also may preferably comprise foam rubber (to assist in weight reduction and reduce breakage upon impact).

Preferably, paint 112 is placed into fluid-holder portion 110 utilizing fill port 166. Fill port 166 preferably is also used for attaching tail section 116 to fluid-holder portion 110, as shown. Tail section 116 preferably threadably couples to fluid-holder portion 110 preferably using male-female thread elements 172, as shown. Preferably, tail section 116, when coupled to fluid holder portion 110, further comprises at least one sealing element, preferably a rubber O-ring 164, preferably in combination with an O-ring groove 162, to assist sealing fill port 166 to allow pressurized fluid to be held within fluid-holder portion 110, as shown. Those with ordinary skill in the art will now appreciate that upon reading this specification and by their understanding the art of attachment as described herein, methods of sealing a re-usable fluid-filling port will be understood by those knowledgeable in such art.

Paintball grenade 104 is preferably thrown through the air by a user with the intent of paintball grenade 104 being controllable and directable towards an intended target with good accuracy and ballistic delivery to the target. Paintball grenade 104 preferably comprises elements and structure as described herein to assist accuracy to a target. Preferably, paintball grenade 104 lands nose-first on trigger activating mechanism 124 wherein trigger portion 120 (at least embodying herein trigger means for triggering such release control means upon impact of the at least one paintball grenade) preferably will trigger opening control valve 126 to open, allowing pressurized paint 112 to flow through the control valve 126 (at least embodying herein release-control means for controlling release of the pressurized marker fluid) and be dispersed by disperser 118, preferably in about a 360-degree arc (see FIG. 2), as shown.

Figure 4:
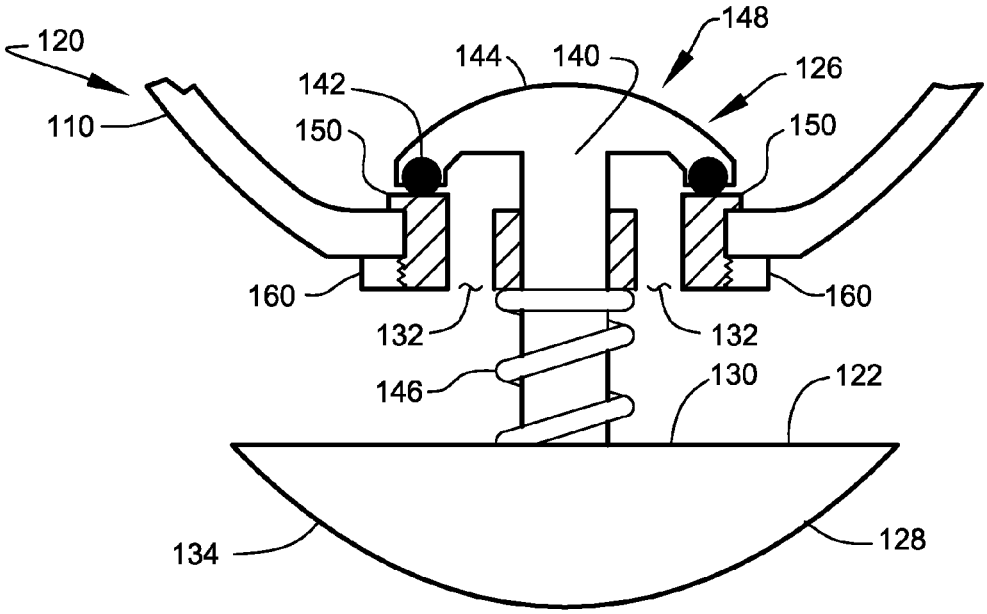
FIG. 4 shows a detail front view, partially in section, of the control valve and trigger portion of the paintball grenade in a valve-closed position, according to the preferred embodiment of FIG. 1.
Figure 5:
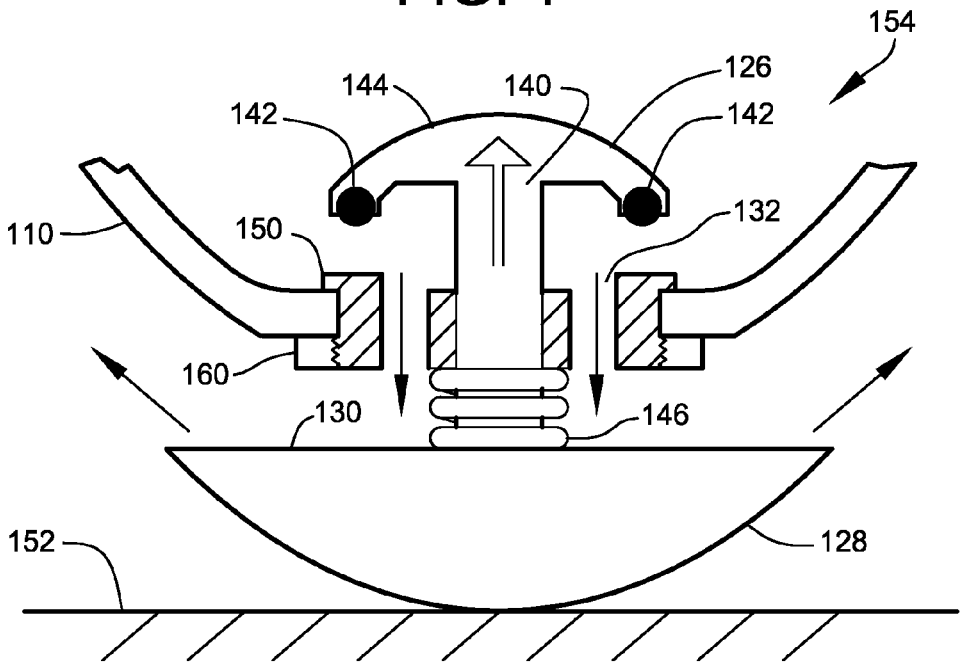
FIG. 5 shows a detail front view, partially in section, of the control valve and trigger portion of the paintball grenade in a valve-open position, according to the preferred embodiment of FIG. 1.

FIG. 4 shows a detail front view, partially in section, of the control valve 126 and trigger portion 120 of paintball grenade 104 in a valve-closed position 148, according to the preferred embodiment of FIG. 1. FIG. 5 shows a detail front view, partially in section, of the control valve 126 and trigger portion 120 of the paintball grenade 104 in a valve-open position 154, according to the preferred embodiment of FIG. 1.

Disperser 118 preferably comprises a deflector 130 that deflects the pressurized paint as it leaves control valve ports 132, as shown. Preferably, deflector 130 comprises a disk 134, preferably with a concave portion 122 facing control valve 126, and a convex nose portion 128, as shown. Preferably, disk 134 has a radius "X" (See FIG. 2) of about three-quarters inches to about one and one-half inches to preferably disperse paint 112 outwardly so that paint 112 will clear the perimeter structure of fluid-holder portion 110 when paint 112 is being dispersed, as shown. Upon reading this specification, those with ordinary skill in the art will now appreciate that, under appropriate circumstances, considering such issues as design preference, user preferences, marketing preferences, cost, structural requirements, available materials, technological advances, etc., other disperser arrangements such as, for example, larger dimensions, other geometric shapes, etc., may suffice.

Figure 17:
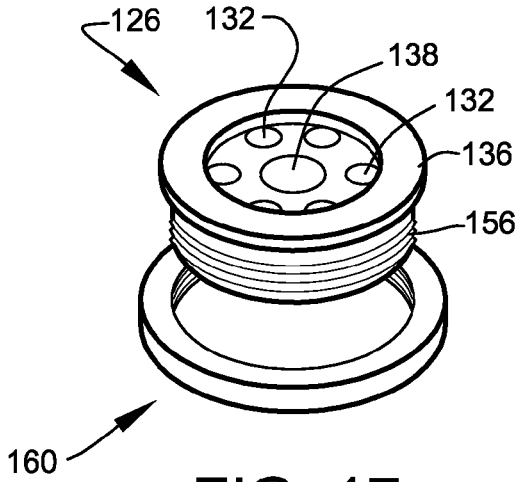
FIG. 17 shows a circular body of the control valve for a paintball grenade according to a preferred embodiment of FIG. 1.

FIG. 17 shows a circular body 136 of the control valve 126 according to a preferred embodiment of FIG. 1. Trigger portion 120 preferably comprises control valve 126, as shown. Control valve 126 preferably comprises a circular body 136 (see FIG. 17) having at least two, and preferably a plurality of, control valve ports 132 that assist evacuation of paint 112 from fluid-holder portion 110 when control valve 126 is open. Alternately preferably, circular body 136 preferably comprises four to six control valve ports 132, preferably equally distanced from each other circumferential about the center 138 of the circular body 136 of control valve 126, as shown. Preferably, circular body 136 is a separately formed element that may be installed onto fluid-holder portion 110, and is preferably attached to the fluid-holder portion 110 using a retainer ring 160, preferably adhered by threadable connection 156, as shown. Preferably, circular body 136 is inserted through fill port 166 and set into exit port 168, then sealed tightly against the fluid-holder portion 110 using a retainer ring 160, as shown. Upon reading this specification, those with ordinary skill in the art will now appreciate that, under appropriate circumstances, considering such issues as design preference, user preferences, marketing preferences, cost, structural requirements, available materials, technological advances, etc., other circular body attachment arrangements such as, for example, adhesive, molded joints, bayonet attachment, integral porting, etc., may suffice.

In such manner as described above, circular body 136 may vary in control valve port 132 sizing thereby providing a means for changing the length, duration and/or force of paint evacuation from the fluid-holder portion 110 and subsequent dispersal through such control valve ports 132, thereby controlling such discharge (in combination with pressurization of the paint within the fluid-holder portion 110).

Control valve 126 preferably comprises valve stem 140, preferably T-shaped, and valve sealing element 142, as shown. Valve stem 140 preferably comprises T-shaped head 144 further comprising valve sealing element 142 and at least one O-ring, preferably rubber as shown. Preferably, when the control valve 126 operates in a valve-closed position 148, valve sealing element 142 seats against valve seat 150, preferably situate at the end of fluid-holder portion 110 preferably directly above control valve ports 132, as shown. Those with ordinary skill in the art will now appreciate that upon reading this specification and by their understanding the art of attachment as described herein, methods of valve sealing will be understood by those knowledgeable in such art.

Valve stem 140 preferably is elongated and connected, preferably integrally, with disperser 118, as shown. Preferably, a valve spring 146 is situated along valve stem 140 preferably between the underside of valve seat 150 and above disperser 118, as shown. Preferably, valve spring 146 assists preventing triggering of trigger portion 120 until paintball grenade impact, as shown. Preferably, valve spring 146 comprises a compression spring, preferably non-corrosive material. Preferably, when at least one portion of convex portion 128 of trigger portion 120 contacts at least one surface 152 with enough inertial force to push the disperser 118 inward toward the fluid-holder portion 110, valve spring 146 (at least embodying herein wherein such trigger means comprises compression-spring means for assisting preventing triggering of such trigger means until impact using at least one compression spring) is compressed and valve stem 140 lifts valve sealing element 142 off of valve seat 150 thereby allowing pressurized paint 112 (fluid-marker) to release through control valve ports 132, as shown (this arrangement at least embodies herein wherein such trigger means comprises such patterned-disperser means). Preferably, paint 112 flows rapidly through control valve ports 132 impacting concave portion 122 of disperser 118 causing paint 112 to be deflected and dispersed in a pattern, preferably in a 360-degree pattern as previously described above. In such manner as described above, disperser 118 (at least embodying herein patterned-disperser means for dispersing the released pressurized marker fluid in at least one pre-determined pattern) not only acts to disperse paint 112, but also comprises a convex nose portion 128 that functions as a trigger activating mechanism 124, as shown. By changing the characteristics of disperser 118, with or without changing control valve ports 132, one can change the dispersal pattern. Upon reading this specification, those with ordinary skill in the art will now appreciate that, under appropriate circumstances, considering such issues as design preference, user preferences, marketing preferences, cost, structural requirements, available materials, technological advances, etc., other dispersal arrangements such as, for example, multi-disk, reversing the convex-concave arrangement, other dispersal geometries, etc., may suffice.

Figure 6:
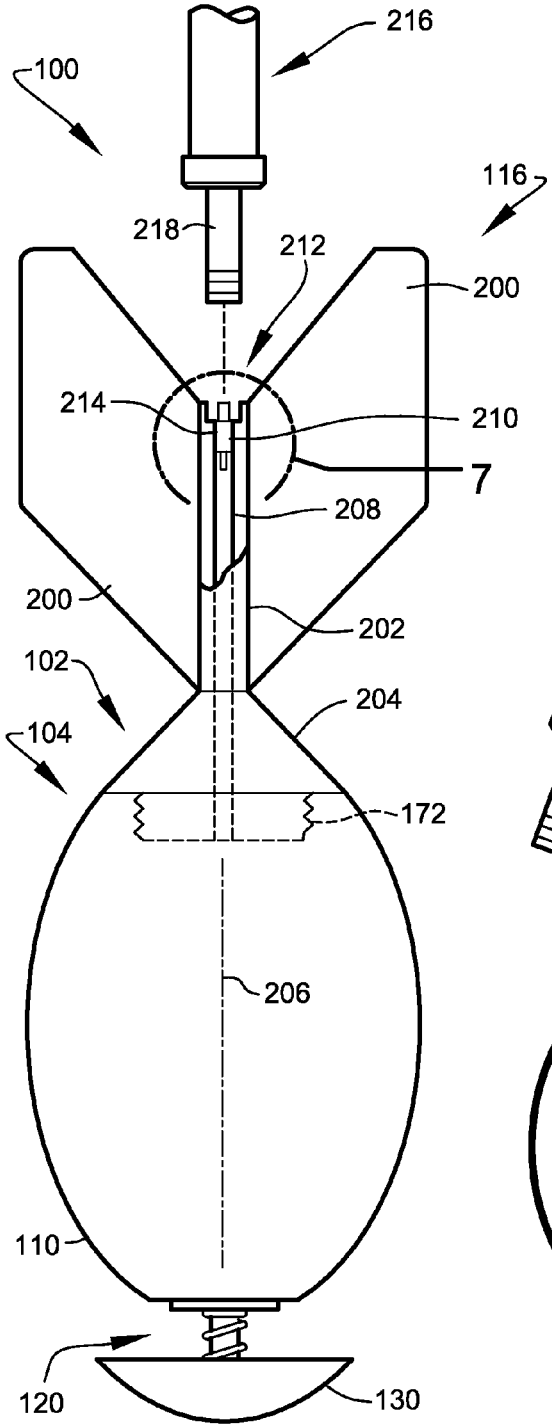
FIG. 6 shows a side view, partially in section, of the fin stabilizer of the paintball grenade, according to the preferred embodiment of FIG. 1.

FIG. 6 shows a side view, partially in section, of tail section 116 of paintball grenade 104, according to the preferred embodiment of FIG. 1. Tail section 116 preferably comprises a means for aerodynamically stabilizing paintball grenade 104 during ballistic flight (thus increasing accuracy). More specifically, tail section 116 is preferably configured to comprises a means for aerodynamically stabilizing paintball grenade 104 during flight, as well as biasing the in-flight orientation of trigger portion 120 to a "forward" position, thus placing deflector 130 of trigger portion 120 in a position of first impact with the landing surface (as illustrated in FIG. 1).

To provide such stabilization and orientation biasing, tail section 116 (at least embodying herein flight-stabilizer means for aerodynamically stabilizing the at least one paintball grenade) is preferably fitted with a set of tailfins 200, as shown. In preferred embodiments of the present invention, at least three, preferably four, tailfins 200 are symmetrically mounted to a tubular extension 202 of tail-cone portion 204 of tail section 116, as shown. Tail fins 200 preferably provide both flight-stabilization and flight-orientation biasing by shifting the center of pressure of paintball grenade 104 behind the center of mass of the assembly, preferably producing an aerodynamic moment acting to substantially continually align the nose of the device in the preferred nose-forward position during flight. Upon reading this specification, those with ordinary skill in the art will now appreciate that, under appropriate circumstances, considering such issues as cost, intended use, etc., other aerodynamic stabilization arrangements such as, for example, the use of alternate drag structures, drag chutes, streamers, etc., may suffice.

Each tail fin 200 is preferably mounted to tubular extension 202 so that the planar aerodynamic surfaces are oriented substantially parallel to longitudinal axis 206, as shown. Upon reading this specification, those with ordinary skill in the art will now appreciate that, under appropriate circumstances, considering such issues as intended use, user preference, etc., other fin arrangements such as, for example, modifying the orientation of the fins and fin surfaces to produce rotational flight, etc., may suffice.

Each fluid-marker 102 of fluid-marker delivery system 100 preferably comprises at least one gas-pressurizer element 210 to assist pressurization of fluid-holder portion 110 with air or other inert gas as previously described. Pressurization of fluid-holder portion 110 is preferably accomplished using one of several preferred techniques further described below.

In a preferred embodiment of fluid-marker delivery system 100, gas-pressurizer element 210 preferably comprises an externally-accessible pressurized-gas valve inlet port 212 designed to permit gas pressurization of fluid-holder portion 110 using an external pressurization device. As illustrated in the cut-away view of FIG. 6, tubular extension 202 of tail section 116 preferably comprises an axial fluid passage 208, preferably extending from external aperture 214 through tail-cone portion 204 to the interior of fluid-holder portion 110.

Fluid passage 208 is preferably fitted with one-way valve 214, as shown. One-way valve 214 preferably functions to permit the entry of pressurized gas into fluid-holder portion 110, while preferably checking the backflow of gas through fluid passage 208 once pressurized.

Figure 7:
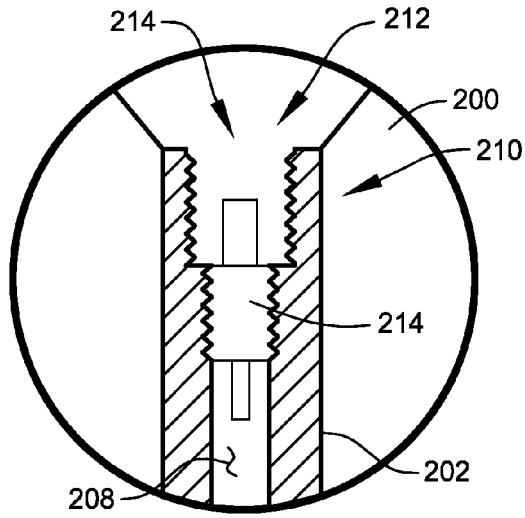
FIG. 7 shows a detail cross-sectional view of Detail 7 of FIG. 6.

FIG. 7 shows a detail cross-sectional view of Detail 7 of FIG. 6. One-way valve 214 preferably comprises a Schrader-type valve, preferably consisting of an externally-threaded hollow cylindrical body containing a poppet-type valve assisted by an internal spring. As best illustrated in FIG. 7, the internal bore of fluid passage 208 is preferably adapted to threadably receive one-way valve 214, as shown. In addition, external aperture 214 of fluid passage 208 is preferably adapted to be engagable with a hand-pump gas pressurizer 216 shown in FIG. 8. Upon reading this specification, those with ordinary skill in the art will now appreciate that, under appropriate circumstances, considering such issues as design preference, user preferences, marketing preferences, cost, structural requirements, available materials, technological advances, etc., other valve arrangements may suffice.

Figure 8:
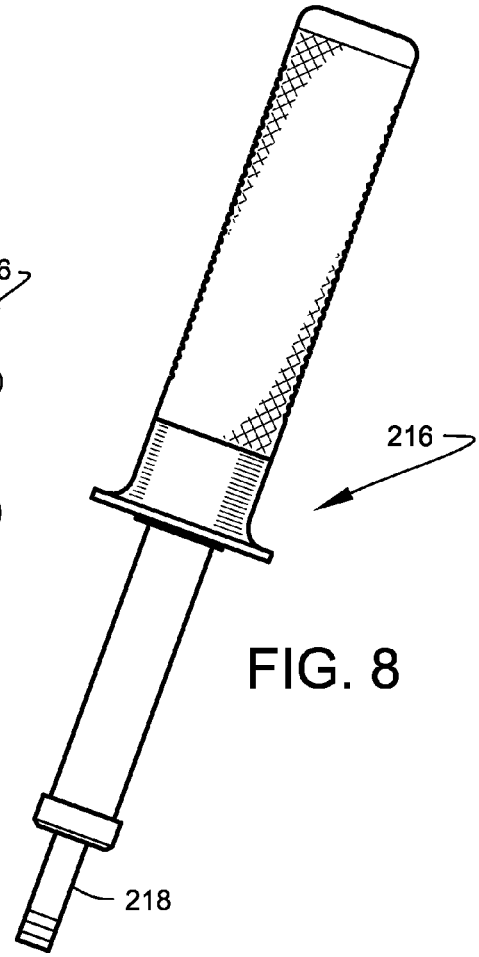
FIG. 8 shows a perspective view, of a hand-pump gas pressurizer, according to the preferred embodiment of FIG. 7.

FIG. 8 shows a perspective view of hand-pump gas pressurizer 216 according to the preferred embodiment of FIG. 6. External aperture 214 of fluid passage 208 is preferably adapted to receive outlet portion 218 of hand-pump gas pressurizer 216, as shown in both FIG. 6 and FIG. 8. To assist retention of outlet portion 218 within fluid passage 208, external aperture 214 is preferably designed to threadably engage outlet portion 218, as shown. Hand-pump gas pressurizer 216 preferably comprises a positive-displacement pump utilizing a manually-operated internal piston. Preferred hand-operated pumps suitable for use as hand-pump gas pressurizer 216 (at least embodying herein wherein such fluid pressurizer means comprises hand-pump means for hand-pumping to pressure the marker fluid) preferably include units designed for inflating bicycle tires.

Figure 9:
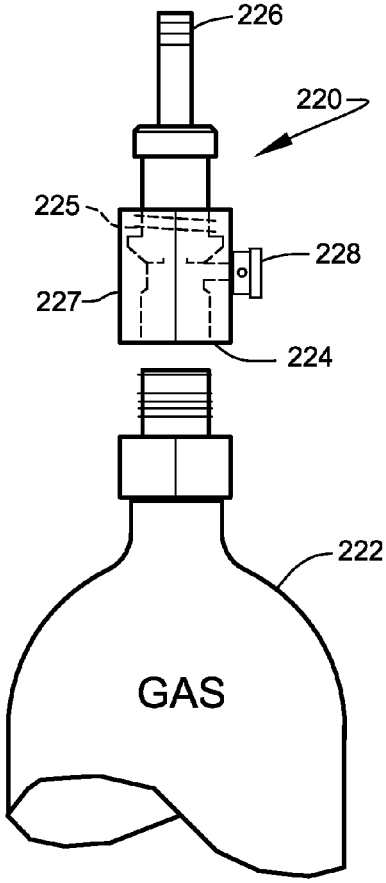
FIG. 9 shows a side view, partially in section, of a gas pressurizer of the fluid-marker delivery systems, according to a preferred embodiment of the present invention.

FIG. 9 shows a side view of an alternate preferred gas-pressurizer fitting 220 of fluid-marker delivery system 100, according to a preferred embodiment of the present invention. Gas-pressurizer fitting 220 is preferably adapted to supply gas propellant from external tank 222, such as, for example, a paintball-marker gas propellant tank, as shown. Gas-pressurizer fitting 220 preferably comprises a valve assembly having an internally threaded end 224 for threadedly engaging the outlet of tank 222, and an externally threaded end 226 coupleable with external aperture 214, as shown.

Gas-pressurizer fitting 220 (at least embodying herein fluid pressurizer means for pressurizing marker fluid) preferably comprises a user-controllable valve 225, such as a manually depressible release valve, to control the movement of gas between tank 222 and externally threaded end 226. In addition, the valve body 227 of gas-pressurizer fitting 220 preferably comprises burst valve member 228 preferably providing a means for pressure release to prevent over pressurization of fluid-holder portion 110. Upon reading this specification, those with ordinary skill in the art will now appreciate that, under appropriate circumstances, considering such issues as cost, user preference, intended use, etc., other charging arrangements such as, for example, inflator pumps using disposable CO2 cartridges, etc., may suffice.

Figure 10:
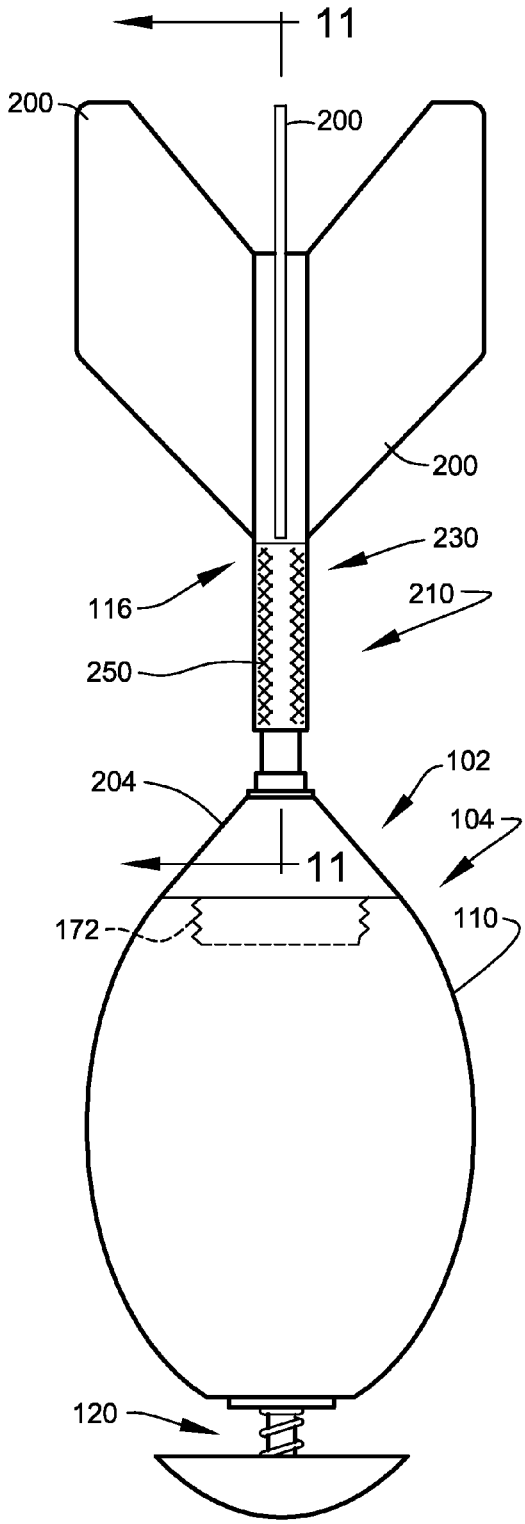
FIG. 10 shows a side view, partially in section, of another gas pressurizer of the fluid-marker delivery systems, according to another preferred embodiment of the present invention.
Figure 11:
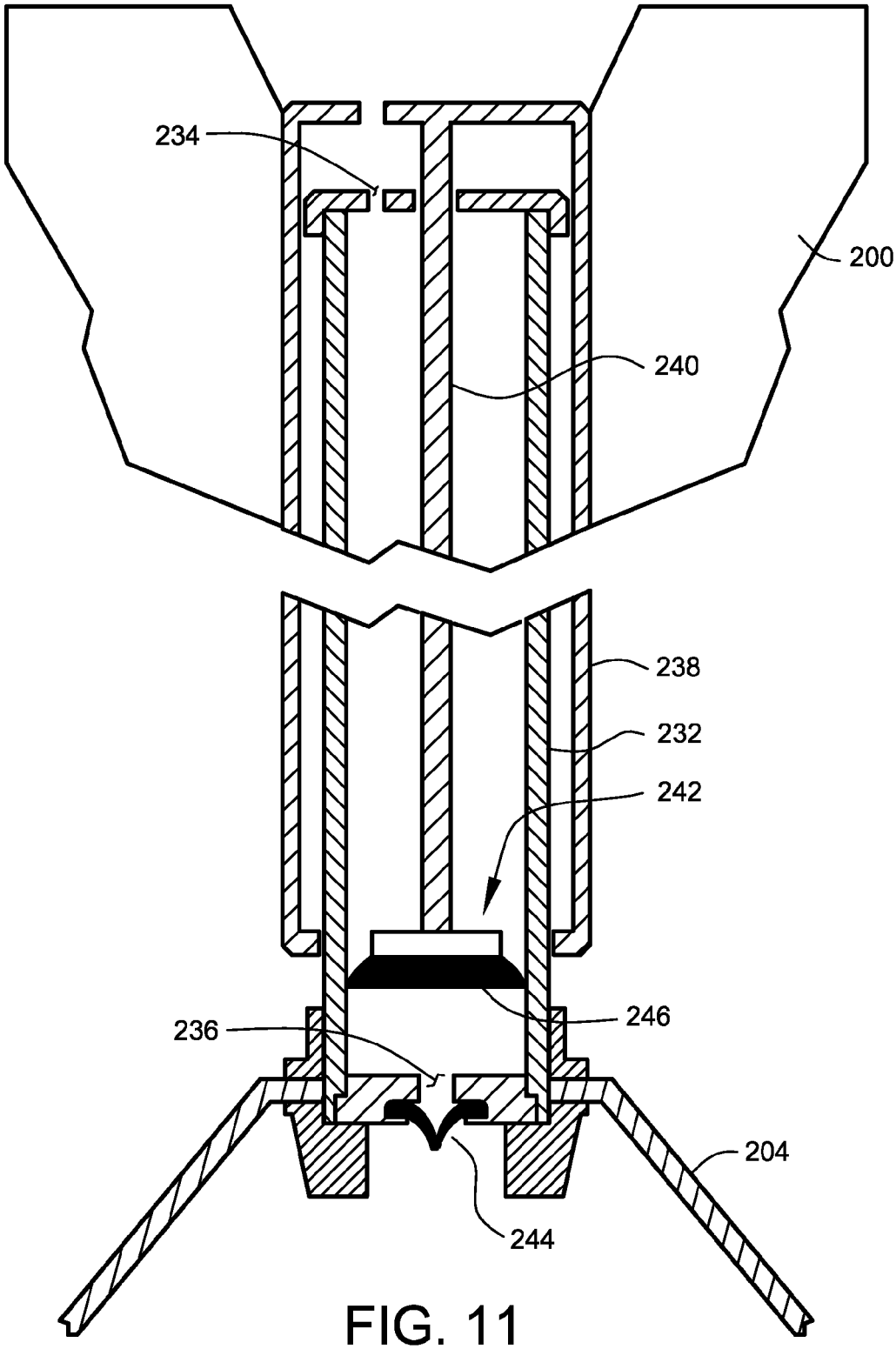
FIG. 11 shows a detail cross-sectional view through section 11-11 of FIG. 10.

In another preferred embodiment of fluid-marker delivery system 100, gas-pressurizer element 210 preferably comprises integral pressurizer 230 designed to permit manual gas pressurization of fluid-holder portion 110. FIG. 10 shows a side view, partially in section, of integral pressurizer 230 of the fluid-marker delivery system 100, according to another preferred embodiment of the present invention. FIG. 11 shows a detail cross-sectional view through section 11-11 of FIG. 10.

In the alternate preferred embodiment of FIG. 10, integral pressurizer 230 comprises a manually operated air pump incorporated within tail section 116, as shown. Integral pressurizer 230 preferably comprises an inner cylindrical pump body 232 having an air-inlet port 234 and an air-outlet port 236, as shown. Preferably, an outer cylindrical sleeve 238 is movably disposed around pump body 232 and preferably supports a coaxially located piston rod 240 passing through the upper distal end of pump body 232, as shown. Piston rod 240 is preferably fitted with piston member 242 reciprocally disposed inside pump body 232, as shown. Air-outlet port 236 is preferably fitted with one-way valve 244, as shown.

Piston member 242 preferably comprises a cupped fiber or plastic piston seal 246, as shown. On a downward stroke the air below piston member 242 pushes the sides of the cup-shaped piston seal 246 against the inner bore of pump body 232, thus forming a seal. Piston member 242 can then push the air through air-outlet port 236 into tail-cone portion 204 and fluid-holder portion 110. One-way valve 244 preferably functions to prevent air from returning to cylindrical pump body 232.

On the up stroke, piston seal 246 deforms to allow air to pass around the periphery of the seal, thereby recharging the cylinder for the next stroke. Air within cylindrical pump body is 232 is preferably replenished through air-inlet port 234. Preferably, about 8-10 pumps of the integral pressurizer 230 pressurize the paintball grenade 104 for preferred use.

Tailfins 200 are preferably mounted to the outer circumference of outer cylindrical sleeve 238, as shown. When not in use, outer cylindrical sleeve 238 is preferably adapted to be secured in a fixed position, preferably using a screw engagement, or bayonet-type lock. To facilitate user manipulation of integral pressurizer 230, a grippable surface 250 is provided on the external circumference of outer cylindrical sleeve 238 below tailfins 200, as shown.

Figure 12A:
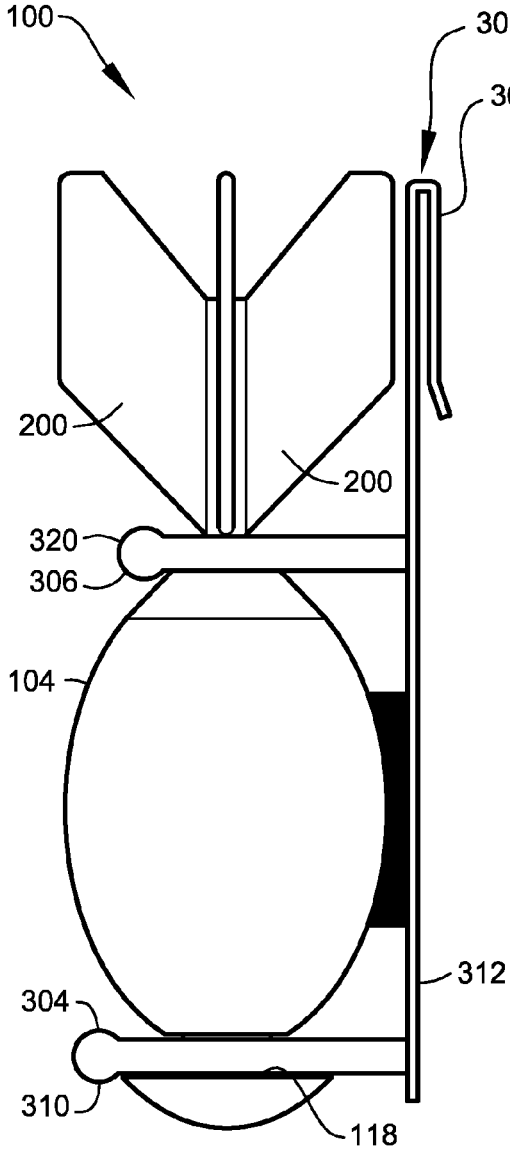
FIG. 12A shows a side view, of a belt-supported paintball grenade holder, according to another preferred embodiment of the present invention.
Figure 12B:
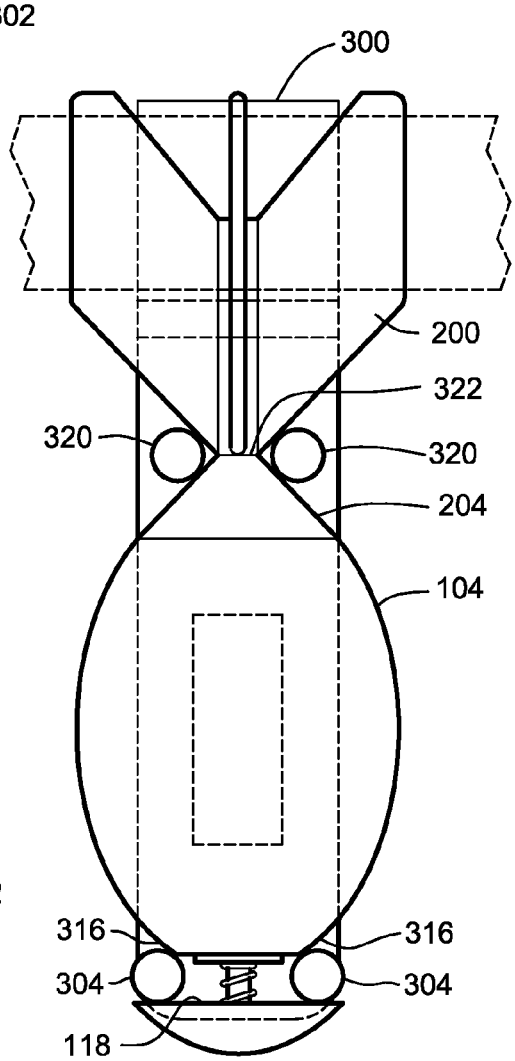
FIG. 12B shows a front view of a belt-supported paintball holder according to the preferred embodiment of FIG. 12A.

FIG. 12A shows a side view of a belt-supported holder 300 according to another preferred embodiment of the present invention. FIG. 12B shows a front view of a belt-supported holder 300 according to the preferred embodiment of FIG. 12A.

During the game of paintball, it is preferable to carry extra paint balls at all the necessary items to be used during the game. Paintball players may carry such extra "ammunition" on multiple accessories either attachable about the player or onto the clothing of such a player. As such, the term used herein for support of the paintball grenade on the player or clothing of the player will be "ammunition-bearing clothing" to include, belts, vest, etc.

It is therefore preferred to have a belt supported holder 300 (at least embodying herein attacher means for removably attaching such trigger blocker means to ammunition-bearing clothing) to hold at least one, and preferably several, paintball grenades 104, as shown. It is also preferable to hold such paintball grenades 104 so that they will not trigger during transport or prior to being thrown by the user for ballistic delivery to the intended target. Belt-supported holder 300 preferably comprises at least one belt coupler 302, preferably a belt clip, preferably a U-shaped belt clip, that may be clipped to, or set over, the top of a belt, as shown. Belt-supported holder 300 preferably comprises a trigger guard 304 (at least embodying herein trigger-blocker means for blocking triggering of such trigger means) and a fin section supporter 306 that preferably work in combination to tightly hold paintball grenade 104, as shown. Trigger guard 304 preferably comprises two rods 310 that protrude from a support surface 312, as shown. Support surface 312 preferably comprising an elongated flat material integrally formed with belt coupler 302, preferably plastic, as shown. Rods 310 preferably are spaced apart and of such diameter to be tightly (friction-fit so as not to easily dislodge during game play) placed between disperser 118 and end 316 of fluid-holder portion 110, as shown. In such manner, rods 310 block trigger portion 120 from triggering and assist support of fluid-holder portion 110, as shown. Fin section supporter 306 preferably comprises two rods 320 also preferably supported from support surface 312, and preferably spaced apart and of such diameter to be easily placed between tail-cone portion 204 and tail fins 200, preferably at the narrowest section 322 of such conversion, as shown. Upon reading this specification, those with ordinary skill in the art will now appreciate that, under appropriate circumstances, considering such issues as design preference, user preferences, marketing preferences, cost, structural requirements, available materials, technological advances, etc., other rod arrangements such as, for example, elliptical, multiple rods, fiber rods, serpentine rods, etc., may suffice.

In use, paintball grenades 104 are carefully inserted between rods 304 and rods 320, as shown. Preferably, rods 304 and rods 320 are slightly flexible and made from a material, such as plastic, which provides side-to-side tensioning of rods 320 respectively towards each other to assist holding the paint ball grenade 104 in place, as shown. As soon as a player removes a paint ball grenade 104 from belt-supported holder 300, the paintball grenade 104 preferably becomes "live" (trigger is unblocked and active) and ready for ballistic delivery to the target.

Figure 14:
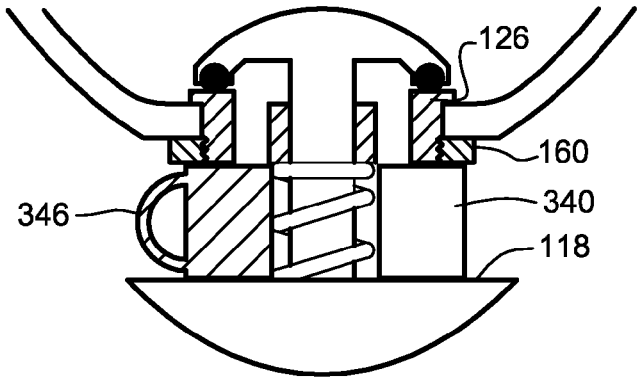
FIG. 14 shows a front view, partially in section, of an alternate trigger blocker for a paintball grenade, according to another preferred embodiment of the present invention.
Figure 15:
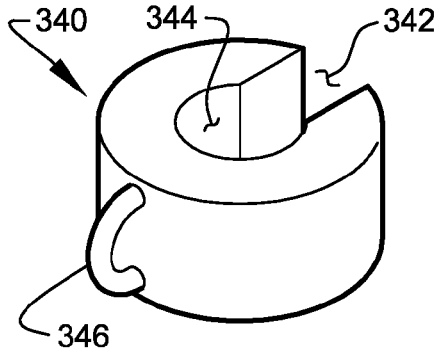
FIG. 15 shows a perspective view, partially in section, of the alternate trigger blocker for a paintball grenade, according to the preferred embodiment of FIG. 14.

FIG. 14 shows a front view, partially in section, of an alternate trigger blocker 340 for a paintball grenade 104, according to another preferred embodiment of the present invention. FIG. 15 shows a perspective view, partially in section, of the alternate trigger blocker 340 for a paintball grenade 104, according to the preferred embodiment of FIG. 14.

Preferably, paintball grenade 104 comprises an alternate trigger blocker 340, as shown. Trigger blocker 340 preferably comprises a C-shaped block of material, preferably plastic or rubber, having an outer perimeter opening 342 and a center opening 344 to accommodate valve stem 140, as shown. Trigger blocker 340 preferably comprises a C-shaped block of material having at least one thickness, preferably one thickness, which friction fits between the disperser 118 and the bottom surface of the control valve 126, thereby blocking compression of valve spring 146, as shown. Upon reading this specification, those with ordinary skill in the art will now appreciate that, under appropriate circumstances, considering such issues as design preference, user preferences, marketing preferences, cost, structural requirements, available materials, technological advances, etc., other trigger blocker 340 arrangements such as, for example, hollow material, wood, metal, ceramic, etc., may suffice.

Preferably, trigger blocker 340 (at least embodying herein wherein such trigger-blocker means comprises spring blocking means for preventing compression of at least one compression spring) comprises at least one handle 346, preferably a half ring portion graspable by a human hand, as shown.

Figure 13:
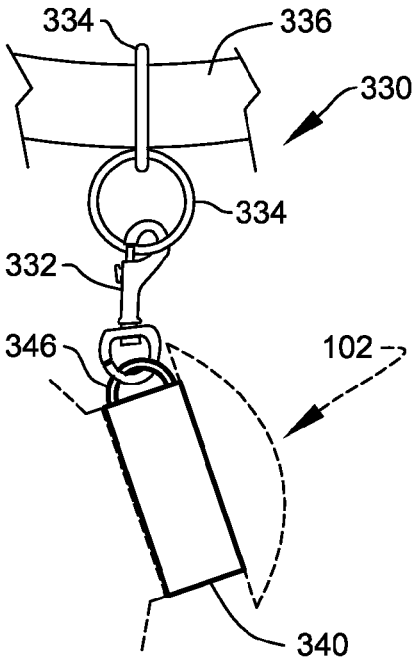
FIG. 13 shows a front view, partially in section, of an alternate belt clip arrangement for a paintball grenade according to another preferred embodiment of the present invention.

FIG. 13 shows a front view, partially in section, of an alternate belt clip arrangement 330 for a paintball grenade 104 according to another preferred embodiment of the present invention. Preferably, paintball grenade 104 may be attachable to a belt, vest or other apparatus, by use of a key-ring-style attacher that can couple to handle 346, as shown. In the illustrated embodiment key ring 332 attaches to handle 346 and to belt-attached rings 334 preferably already attached to a belt 336, as shown. In use, this arrangement allows a user to simply pull the paintball grenade 104 off of the trigger blocker 340 as the trigger blocker 340 is coupled to belt 336, as shown. Upon reading this specification, those with ordinary skill in the art will now appreciate that, under appropriate circumstances, considering such issues as design preference, user preferences, marketing preferences, cost, structural requirements, available materials, technological advances, etc., other attachment arrangements such as, for example, attachment to a vest, weapon, vehicle, post, etc., may suffice.

Figure 16:
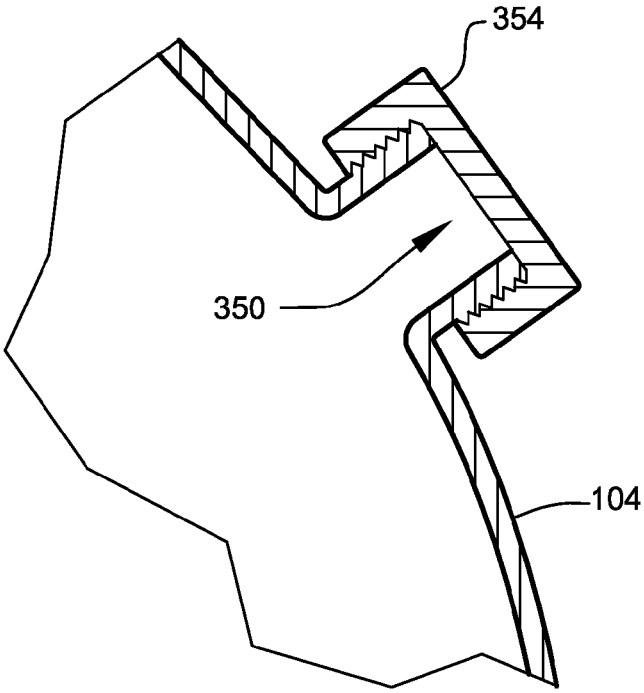
FIG. 16 shows an alternate section view, of an alternate fluid delivery port of the fluid-holder portion of the paintball grenade according to another preferred embodiment of the present invention.

FIG. 16 shows an alternate section view, of an alternate fluid delivery port 350 of the fluid-holder portion 110 of the paintball grenade 104 according to another preferred embodiment of the present invention. In an alternately preferred embodiment of the paintball grenade 104, the fin section 116 may be permanently attached to the fluid-holder portion 110 and an alternately preferable fluid delivery port 350 may be provided, as shown. Fluid delivery port 350 preferably is placed along the fluid-holder portion 110, preferably closely adjacent the upper portion of the fluid-holder portion 110 nearer the fin section than the nose of the paintball grenade 104. Preferably, fluid delivery port 350 comprises a single opening having a single cap 354, preferably threadably connected to fluid-holder portion 110, as shown. Upon reading this specification, those with ordinary skill in the art will now appreciate that, under appropriate circumstances, considering such issues as design preference, user preferences, marketing preferences, cost, structural requirements, available materials, technological advances, etc., other fluid port arrangements such as, for example, single port openings, removable trigger portion to allow fluid placement and then trigger placement, multiple chambers and ports, customized syringe filling ports, etc., may suffice.

The following is a preferred example of the general sequence of events during paintball game play: Before the start of a paintball game, a player would preferably assemble one or more paintball grenades; open the fill port on the body of the grenade, pour paintball paint in to the appropriate level, and close or cap the fill port; then, the player would preferably temporarily block the trigger, connect an air pump to the fluid chamber and pump air into the chamber to pressurize the grenade; then, clip the paintball grenade to his/her webbing or belt (with built-in trigger blocker). To use during play, the player would pull firmly on the grenade and it would release from the players belt or webbing, while simultaneously arming. The player would then throw the grenade whereby it would detonate on impact and release paint in all directions, spraying the opponent and taking him out of the game. The player would than recover the device, refill with paint, and pressurize the grenade for subsequent use.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system relating to spraying liquid from at least one reusable paintball grenade, said system comprising:

a) at least one marker-container structured and arranged to contain at least one pressurized marker liquid;

b) at least one release-controller valve structured and arranged to control release of such at least one pressurized marker liquid;

c) at least one patterned-disperser structured and arranged to disperse such released pressurized marker liquid in at least one pre-determined pattern; and d) at least one spring-loaded trigger structured and arranged to trigger said at least one release-controller valve upon impact of the at least one reusable paintball grenade;

e) wherein said at least one spring-loaded trigger comprises said at least one patterned-disperser;

f) wherein said at least one marker-container comprises at least one filling-aperture structured and arranged to permit filling of said at least one marker-container with such at least one pressurized marker liquid;

g) wherein said at least one marker-container comprises at least one closure structured and arranged to close said at least one filling-aperture;

h) wherein said at least one marker-container comprises at least one aerodynamic geometry structured and arranged to geometrically assist in-flight aerodynamic stabilization of the at least one reusable paintball grenade when thrown; and i) wherein, after such at least one pressurized marker liquid has been released by said at least one release-controller valve, the at least one reusable paintball grenade may be re-filled with such at least one pressurized marker liquid and reused.

2. The system according to claim 1 further comprising at least one flight-stabilizer structured and arranged to aerodynamically stabilize the at least one reusable paintball grenade.

3. The system according to claim 2 wherein said at least one flight stabilizer comprises at least one liquid pressurizer structured and arranged to pressurize marker liquid.

4. The system according to claim 3 wherein said at least one liquid pressurizer comprises at least one hand-pumper structured and arranged to hand-pump to pressure such marker liquid.

5. The system according to claim 1 wherein said at least one pattern-disperser comprises at least one reflector structured and arranged to reflect such released pressurized marker liquid in the at least one pre-determined pattern.

6. The system according to claim 5 wherein said at least one reflector disperses such released pressurized marker liquid in a 360-degree pattern.

7. The system according to claim 1 wherein said at least one patterned-disperser disperses such released pressurized marker liquid in an arcuate pattern of not less than about 180-degrees and not more than about 360-degrees.

8. The system according to claim 2 wherein said at least one flight-stabilizer comprises at least one flight-orientation biaser structured and arranged to assist biasing the in-flight orientation of said at least one spring-loaded trigger toward at least one ballistic-flight position promoting first impact with said at least one spring-loaded trigger upon impact of the at least one reusable paintball grenade.

9. The system according to claim 2 wherein said at least one flight-stabilizer comprises at least three fins.

10. A system relating to spraying liquid from at least one reusable paintball grenade, said system comprising:

a) at least one marker-container structured and arranged to contain pressurized marker liquid;

b) at least one release-controller valve structured and arranged to control release of such pressurized marker liquid;

c) at least one spring-loaded trigger structured and arranged to trigger said at least one release-controller valve upon impact of the at least one reusable paintball grenade; and d) at least one flight-stabilizer structured and arranged to aerodynamically stabilize the at least one reusable paintball grenade;

e) wherein said at least one marker-container comprises at least one filling-aperture structured and arranged to permit filling of said at least one marker-container with such at least one pressurized marker liquid;

f) wherein said at least one marker-container comprises at least one closure structured and arranged to close said at least one filling-aperture; and g) wherein, after such at least one pressurized marker liquid has been released by said at least one release-controller valve, the at least one reusable paintball grenade may be re-filled with such at least one pressurized marker liquid and reused.

11. The system according to claim 10 wherein said at least one flight-stabilizer comprises at least one liquid pressurizer structured and arranged to pressurize marker liquid.

12. The system according to claim 11 wherein said at least one liquid pressurizer comprises at least one hand-pumper structured and arranged to hand-pump to pressure such marker liquid.

13. The system according to claim 10 further comprising: at least one patterned-disperser structured and arranged to disperse such released pressurized marker liquid in at least one pre-determined pattern.

14. The system according to claim 13 wherein said at least one spring-loaded trigger comprises said at least one patterned-disperser.

15. The system according to claim 1 further comprising at least one trigger-blocker structured and arranged to block triggering of said at least one spring-loaded trigger.

16. The system according to claim 15 wherein said at least one trigger-blocker comprises at least one spring-blocker structured and arranged to prevent compression of said at least one spring-loaded trigger.

17. The system according to claim 15 further comprising at least one attacher structured and arranged to removably attach said at least one trigger-blocker to ammunition-bearing clothing.

18. The system according to claim 17 wherein said at least one attacher comprises said at least one trigger-blocker.

19. The system according to claim 15 wherein said at least one trigger-blocker comprises a single C-shaped block structured and arranged to be situate between said at least one patterned-disperser and said at least one release-controller valve.

20. The system according to claim 19 wherein said single C-shaped block comprises at least one handle structured and arranged to be hand graspable by a human hand.

21. The system according to claim 15 wherein said at least one trigger-blocker comprises at least one set of two projecting rods structured and arranged to trigger-block said at least one spring-loaded trigger and to support the at least one reusable paintball grenade.

* * * * *